US007926475B2

(12) United States Patent
Jones

(10) Patent No.: US 7,926,475 B2
(45) Date of Patent: Apr. 19, 2011

(54) ARCHERY RELEASE

(75) Inventor: Brian K. Jones, Winchester, KY (US)

(73) Assignee: Scott Archery Manufacturing, Clay City, KY (US)

( * ) Notice: Subject to any disclaimer, the term of this patent is extended or adjusted under 35 U.S.C. 154(b) by 462 days.

(21) Appl. No.: 12/146,075

(22) Filed: Jun. 25, 2008

(65) Prior Publication Data

US 2009/0056689 A1 Mar. 5, 2009

Related U.S. Application Data

(60) Provisional application No. 60/970,111, filed on Sep. 5, 2007.

(51) Int. Cl.
*F41B 5/18* (2006.01)

(52) U.S. Cl. ..... 124/35.2

(58) Field of Classification Search ..... 124/35.2
See application file for complete search history.

(56) References Cited

U.S. PATENT DOCUMENTS

| | | | | |
|---|---|---|---|---|
| 228,302 | A * | 6/1880 | Beard | 124/35.2 |
| 4,036,204 | A | 7/1977 | Scott | |
| 4,160,437 | A | 7/1979 | Fletcher | |
| 4,567,875 | A | 2/1986 | Fletcher | |
| 4,574,767 | A | 3/1986 | Gazzara | |
| 4,620,523 | A | 11/1986 | Peck | |
| 4,674,469 | A | 6/1987 | Peck | |
| 4,881,516 | A | 11/1989 | Peck | |
| 4,982,718 | A * | 1/1991 | Hamm et al. | 124/35.2 |
| 5,205,268 | A | 4/1993 | Savage | |
| 5,448,983 | A | 9/1995 | Scott | |
| 5,595,167 | A | 1/1997 | Scott | |
| 5,596,977 | A | 1/1997 | Scott | |
| 5,765,536 | A | 6/1998 | Scott | |
| 5,850,825 | A | 12/1998 | Scott | |
| 6,032,661 | A | 3/2000 | Goff et al. | |
| 6,736,124 | B2 | 5/2004 | Carter | |
| 6,953,035 | B1 | 10/2005 | Summers et al. | |

OTHER PUBLICATIONS

2006 Scott Archery Products Catalog.

* cited by examiner

*Primary Examiner* — John Ricci
(74) *Attorney, Agent, or Firm* — Warner Norcross & Judd LLP

(57) ABSTRACT

An archery release including a release head, a moveable hook, and an adjustable jaw. The adjustable jaw can be moved relative to the hook to adjust a gap defined between the hook and the adjustable jaw when the hook is in a closed position to capture a bowstring. Optionally, the jaw can be completely removed from the release head to render the release a hook-only release. The jaw can include a free end separated from the release head by a distance. An adjustment element can be joined with the jaw, and operable in at least one of an adjustment mode to change the distance of the free end from the release head, and a removal mode to render the jaw completely removable from the release head. A method also is provided for modifying the archery release to suit an archer's preferences.

21 Claims, 7 Drawing Sheets

ARCHERY RELEASE

This application claims benefit to U.S. Provisional Patent Application 60/970,111, filed Sep. 5, 2007, which is hereby incorporated by reference.

BACKGROUND OF THE INVENTION

The present invention relates to an archery bowstring release.

Conventional archery releases are designed to temporarily hold a bowstring of an archery bow so that an archer can pull on the release and subsequently draw the bowstring to shoot an arrow from the bow. Archery releases typically assist an archer in quickly and cleanly releasing the bowstring. In general, archery releases consistently release the bowstring when the archer shoots the arrow, and thus increase the accuracy of the archer.

A common release includes a release head, a trigger mechanism, a hook pivotally joined with the head and actuatable by the trigger mechanism, a fixed immovable jaw opposing the hook, and a wrist strap or handle designed so that a user can hold the release. In use, an archer nocks an arrow on the bowstring and secures the hook of the release around the bowstring. The user then draws the bowstring by pulling the release. After the user fully draws the bowstring, aims the bow and is prepared to shoot the arrow, the user actuates the trigger mechanism. This moves the hook and subsequently disengages the bowstring so that the bowstring can utilize its stored energy and propel the arrow from the bow.

A common type of release includes a combination of a hook and an immovable fixed jaw which cooperate to hold a bowstring. Such releases are typically used in a variety of archery sports, such as shooting tournaments. An example of such a release is known as a Scott "Ibex" thumb trigger release, which is offered by Scott Archery Manufacturing. This release includes a release head having a single pivotable hook and an adjacent fixed, permanent and immovable jaw, which opposes the hook and forms a portion of a bowstring notch. The release head is joined with a handle having finger grooves so that a user can grasp the handle. A thumb actuated trigger mechanism releases the hook when the trigger is actuated by an archer's thumb.

Another conventional release is known a back tension release. Most back tension releases include only a hook to hold the bowstring before it is released. An example of a popular back tension release is known as a Scott "Ibex BT" release, which also is offered by Scott Archery Manufacturing. This release includes a release handle, a release head bracket, and a single hook pivotally secured to the release head bracket. The hook engages and holds the bowstring, and is the only component of the release that engages the bowstring to hold it. To operate this "hook-only" back tension release, an archer squeezes together their shoulder blades, or in other words, "tenses their back." Because the archer holds the release in their hand, the back movement moves the hand, and in turn, moves the release enough so that the hook pivots and releases the bowstring.

Although the above releases are very effective, applicants have discovered two issues. First, with the combination hook and immovable fixed jaw release described above, when the hook is in a closed position, its tip or end is adjacent the fixed, immovable jaw, with the two being separated by a small gap. Some archers prefer that this gap be large, that is, the hook distanced from the fixed jaw as far as possible while still enabling the hook to retain a drawn bowstring. Other archers prefer that the gap be small, with the hook tip very near or even engaging the fixed immovable jaw. Current constructions do not adequately address this preference issue. Second, many archers, particularly tournament archers, desire to switch between different types of releases depending on conditions. As an example, an archer may desire to shoot with a thumb trigger release at one event, and then shoot with a back tension release, or some other hook-only release at another event. Accordingly, the archer must purchase both types of releases, which can be expensive.

SUMMARY OF THE INVENTION

The present invention provides an archery release including a release head, a moveable hook, and an adjustable jaw. In one embodiment, the adjustable jaw can be moved relative to the hook to adjust a gap defined between the hook and the adjustable jaw when the hook is in a closed position to capture a bowstring.

In another embodiment, the jaw can be completely removable from the release head to render the release a hook-only release.

In yet another embodiment, the jaw includes a free end separated from the release head by a distance. An adjustment element can be joined with the jaw, and operable in at least one of an adjustment mode to change the distance of the free end from the release head, and a removal mode to render the jaw completely removable from the release head.

In a further embodiment, the release head can include an axis, with the jaw being extendable and retractable relative to the release head along the axis in the adjustment mode. Optionally, this axis can be linear. Further optionally, the release head can define a hole, with the hole along the axis, and a portion of the jaw received within the hole.

The present invention provides a simple and efficient archery release that is easily adjusted or transformed from a combination hook and fixed jaw release to a hook-only release and vice versa. With its adjustable fixed jaw, an archer can conveniently set the gap between the hook and fixed jaw of the release. This enables the archer to shoot a release with the gap sized to their preference, which can increase release consistency, improve shooting accuracy and accordingly boost shooting confidence. Where the fixed jaw is optionally fully removable from the release, an archer can quickly and easily convert from a combination hook and fixed jaw release configuration to a hook-only configuration, and vice versa. In turn, this enables an archer to purchase only one release, and yet shoot with either a combination hook and fixed jaw or hook-only configuration.

These and other objects, advantages and features of the invention will be more readily understood and appreciated by reference to the detailed description of the invention and the drawings.

DETAILED DESCRIPTION OF THE CURRENT EMBODIMENT

I. Overview and Definitions

Figure 1:
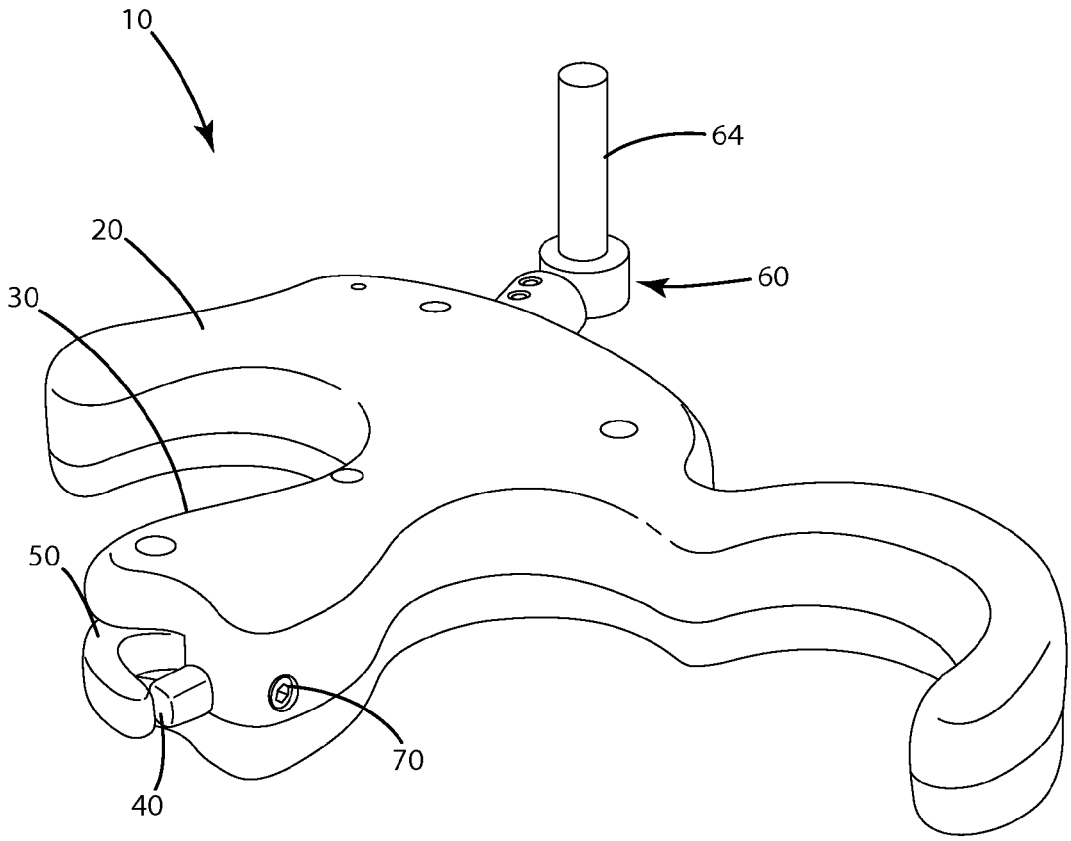
FIG. 1 is a perspective view of a current embodiment of an archery release of the present invention.
Figure 2:
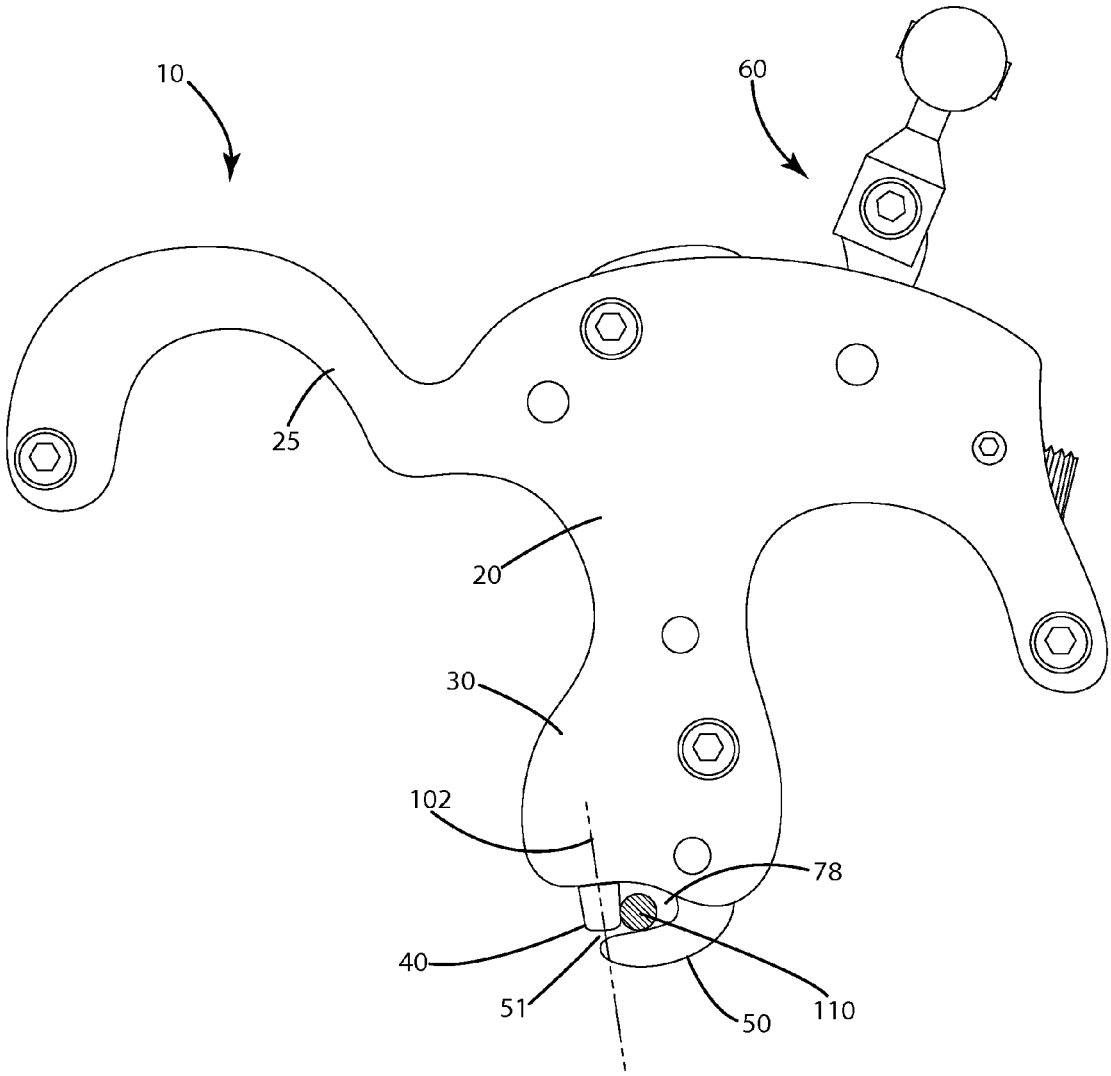
FIG. 2 is a top view of the release of the present invention in a first closed position holding a bowstring.
Figure 3:
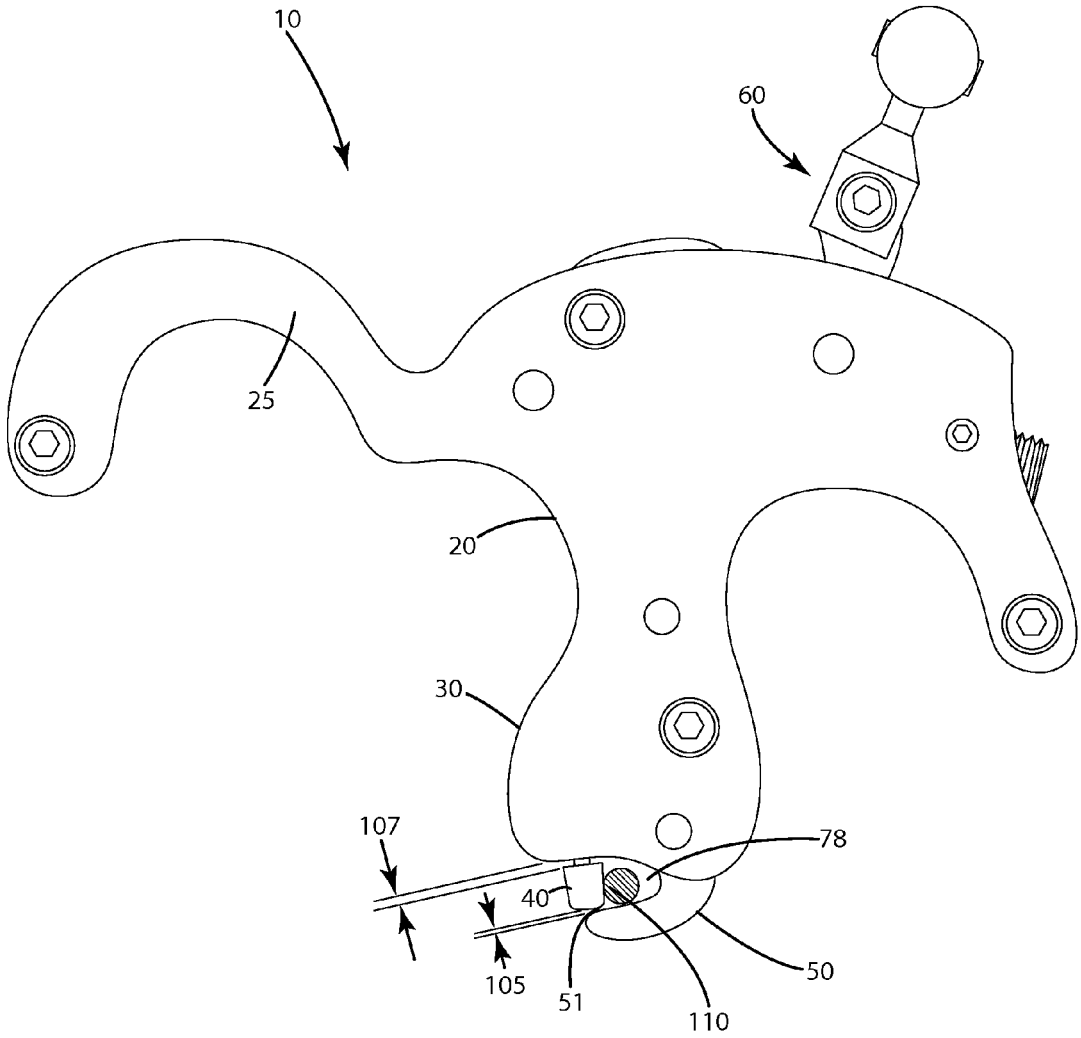
FIG. 3 is a second top view of the release, in a second closed position with the gap of the release changed, and holding a bowstring.
Figure 4:
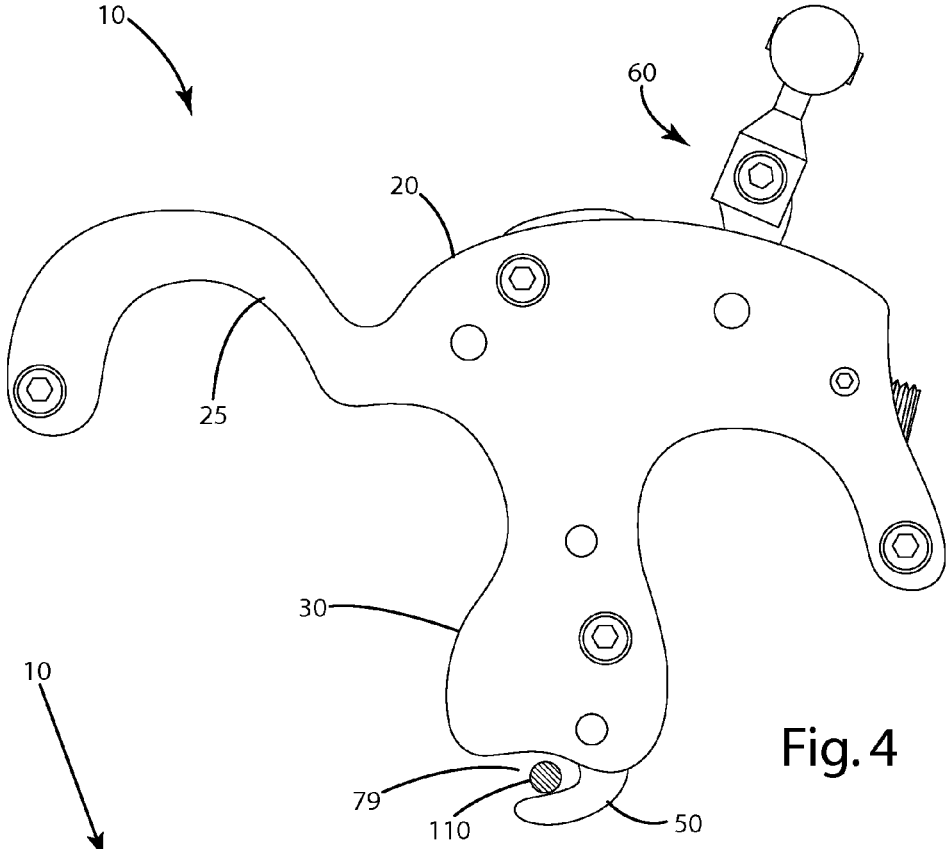
FIG. 4 is a third top view of the release in a third closed position with the fixed jaw removed from the release, and holding a bowstring.

A current embodiment of the archery release of the present invention is shown in FIGS. 1-4 and generally designated 10. The release 10 generally includes a release body 20 having a release head 30, an adjustable fixed jaw 40, a moveable hook or jaw 50, and a trigger mechanism 60. The moveable hook 50 is adapted to move relative to the release head 30, and when attached, the adjustable fixed jaw 40. The adjustable fixed jaw 40 is joined with the release head with a mechanism that enables the fixed jaw to be adjustable in profile relative to the release head, and thus to enable an archer to select a gap 51, or distance between the hook 50 and adjustable fixed jaw 40, as shown in comparing FIGS. 2 and 3. Optionally, the adjustable fixed jaw 40 can be completely removed from the release head 30, as shown in FIG. 4, thereby converting the release to a hook-only release.

The following terms will have the definitions presented. As used herein, "bowstring" refers to an actual bowstring of an archery bow and any device or component adapted to join with a bowstring of an archery bow and aid an archer in drawing or releasing the bowstring, including but not limited to: rope loops, which are attached to the bowstring above and below the location where an arrow nock rests; and receivers, for example, a metal loop or partial loop that is joined with the bowstring above and below, or only above, or only below the location where the arrow nock rests on the bowstring.

As used herein "archery bow" refers to any compound bow, recurve bow, long bow, crossbow or any other device that propels or is capable of propelling an arrow, bolt or other similar projectile.

II. Components

Referring to FIGS. 1-5, the components of the release 10 will now be described in detail. The release body 20 generally includes a release head 30, an adjustable fixed jaw 40, a moveable hook or jaw 50, and a trigger mechanism 60.

The adjustable fixed jaw 40 extends along an axis 102 that projects from the release head 30. The axis 102 can be coaxial or otherwise aligned with a hole 32 defined by the release head. The hole 32 can be of any dimension or geometric shape adapted to receive the base 42 of the fixed adjustable jaw 40. As shown, the hole is generally of a cylindrical shape that conforms to the general shape of the fixed end or base 42 of the jaw 40.

The adjustable fixed jaw 40 can come in a variety of configurations. As shown, in one configuration, the jaw 40 includes a jaw free end 41 and a base 42. The free end is distal from the release head by a pre-selected distance, and generally forms the terminating portion of the jaw 40.

The fixed jaw 40 can include or be joined with an adjustment element that is operable in at least one of an adjustment mode to change the distance of the free end 41 from the release head 30, and a removal mode to render the jaw 40 completely removable from the release head. As shown, the adjustment element 46 can include the jaw base 42 configured to join with the release head 30 in a manner that facilitates movement of the free end 41 toward and/or away from the release head. Optionally, the base 42 can be received in the hole 32 so that the free end is moveable toward and away from the release head along the axis 102, in which case, the jaw retracts and extends along the axis of the release head.

To facilitate the connection between the jaw 40 and the release head, the base can include a post 44 extending from the lower portion of the jaw 40. This post can be of any geometric shape or dimension, for example, of a round, square, elliptical, triangular or other cross section. As shown, the post can be of a length that is less than the depth of the hole 32 so that the post 44 does not bottom out in the hole 32, thereby preventing the jaw from being fully retracted toward the release head 30. Further, the post can be configured so that it fits within the hole 32, and is of a slightly smaller dimension than the hole 32 so that it is slideably received within the hole 32. Optionally, the base 42 can include a stop 45 that extends outward from the base 42 so that the stop engages the release head to prevent unwanted retraction of the base 42 into the hole. This stop can protrude around the entire periphery of the base 42, or around only a portion of the base as desired.

In an alternative construction, a particular release can be provided with multiple fixed jaws, each having several differently shaped free ends to engage a bowstring in a particular manner. Further, these multiple fixed jaws can include free ends of specific lengths and dimensions so that when inserted into the hole 32, the different free ends project from the release head at varying profiles to enable a user to alter the gap 51 between the free end and the hook 40—simply by changing from one adjustable jaw to another.

Figure 5:
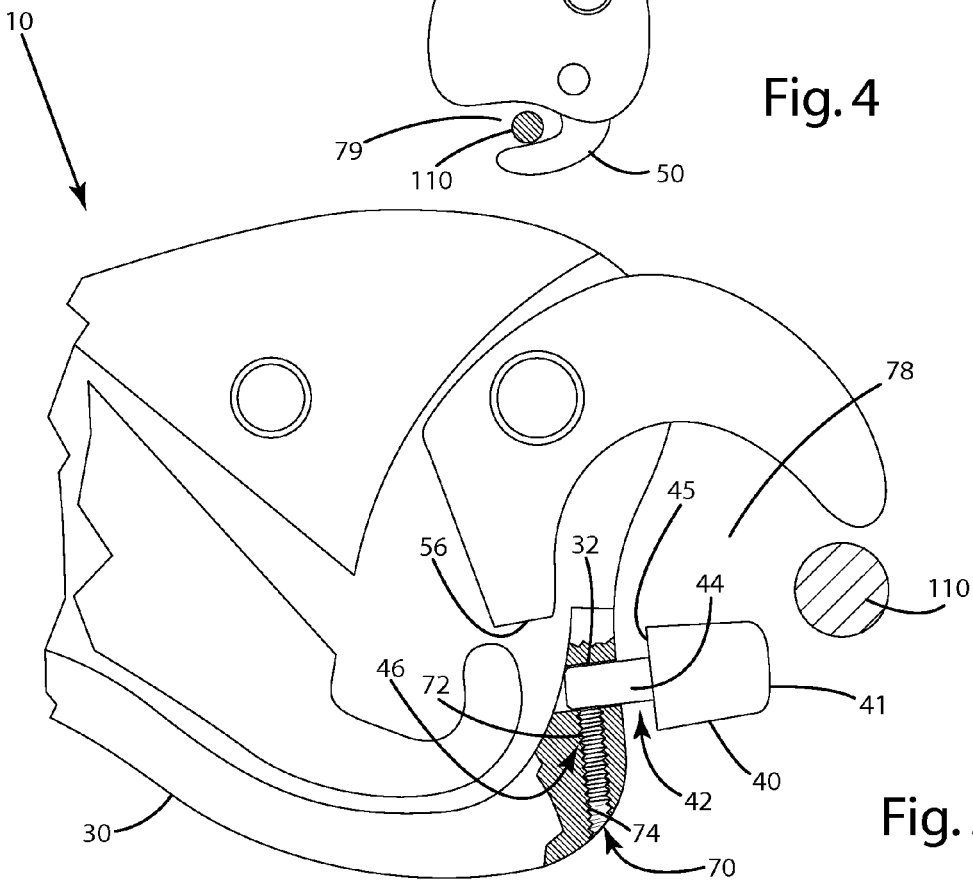
FIG. 5 is a sectional view of the release in an open position.

As shown in FIG. 5, the release 10 can include a locking element 70 joined with the head 30. This locking element can engage the base to selectively lock the jaw 40 in a fixed position in which the free end 41 is stationary relative to the release head 30. Optionally, the locking element can include a set screw 72 threadably received in a set screw hole 74. The set screw hole can be defined by the release head so that it intersects the hole 32, wherein the set screw can engage the base, for example the post, and hold it in a fixed, immovable position.

In an alternative embodiment that is not shown, the jaw 40 can include a threaded base, which screws into a threaded hold defined by the release head. The base and/or hole can include a coating, for example, Locktite®, or some device that ensures that after the base is moved with substantial force by a user for adjustment, it does not readily move farther. Further alternatively, the jaw 40 can be joined with a locking cam mechanism or toothed gear mechanism, which extends and retracts the free end of the jaw relative to the release head. A variety of other mechanisms are contemplated for movement of the adjustable fixed jaw 40 to adjust its profile relative to the release head.

Returning to the jaw 40 shown in FIGS. 1-5, with the adjustment element 46, it can be seen that the jaw 40 is optionally completely removable from the release head in a removal mode. For example, when the locking element is disengaged from the jaw so that the jaw is freely moveable, the post 44 can be completely removed from the hole 32 as shown in FIG. 4. If desired, the post 44 or base 42 can include a second stop or protrusion (not shown) that engages the release head 30 to prevent unwanted removal of the jaw 40 from the release.

Upon removal of the jaw 40 from the release head, the release 10 is transformed to a hook-only release. Optionally, this removal of the fixed jaw 40 from the release head 30 also converts the bowstring capture notch from a substantially fully surrounded capture notch 78 (FIGS. 2-3) to an open capture notch 79 (FIG. 4), wherein the hook is the primary holder of the bowstring 110.

Referring to FIGS. 1-5, the hook 50 can be pivotally joined with the release head 30, and optionally further joined with the trigger mechanism 60 so that an archer can actuate the hook to release the bowstring 110. The hook 50 can include a hook free end 52, which when the release is in the closed position, is adjacent the jaw free end 41, and optionally separated by a distance 105, also referred to as the "gap 51." As discussed herein, the distance 105, or gap 51, is adjustable by extending or retracting the fixed jaw 40 a distance, for example, distance 107 when the release is in an adjustment mode as described below.

Opposite the hook free end 52, the hook can include a hook sear edge 56, which engages other portions of the trigger mechanism 60, as described below. The hook 50 can be joined with the release head 30 via a hook pivot pin 56. With this construction, the trigger mechanism 60 can engage the hook sear edge 56 to hold the hook so that it will not pivot about the pivot pin 56. When so engaged, the hook 50 is able to hold a bowstring 110 as a user draws the bowstring with the release 10. The trigger mechanism 60 can also disengage the hook sear edge 56 so that the hook 50 is free to pivot, thereby releasing the bowstring 110 from the release 10.

As illustrated in FIGS. 1-5, the release 10 can include a variety of other suitable features and components. For example, the release head 30 optionally can be joined with a release body 20. This release body 20 and all or a portion of the release head 30 can define a recess 24 sufficiently sized to house all or a portion of the other components of the release 10. The release body also can be joined with a grasping element 25 so that a user can grasp the release and draw the bowstring. This grasping element can come in a variety of constructions. For example, as shown, the element 25 can be a handle defining one or more grooves for the digits of an archer's hand. The number of grooves can be varied as desired depending on personal preference. Alternatively, the grasping element 25 can be a wrist strap construction. An exemplary wrist strap is shown in U.S. Pat. No. 5,595,167 to Scott, which is hereby incorporated by reference. Other buckle, Velcro® or loop wrist straps may be substituted as desired.

Figure 6:
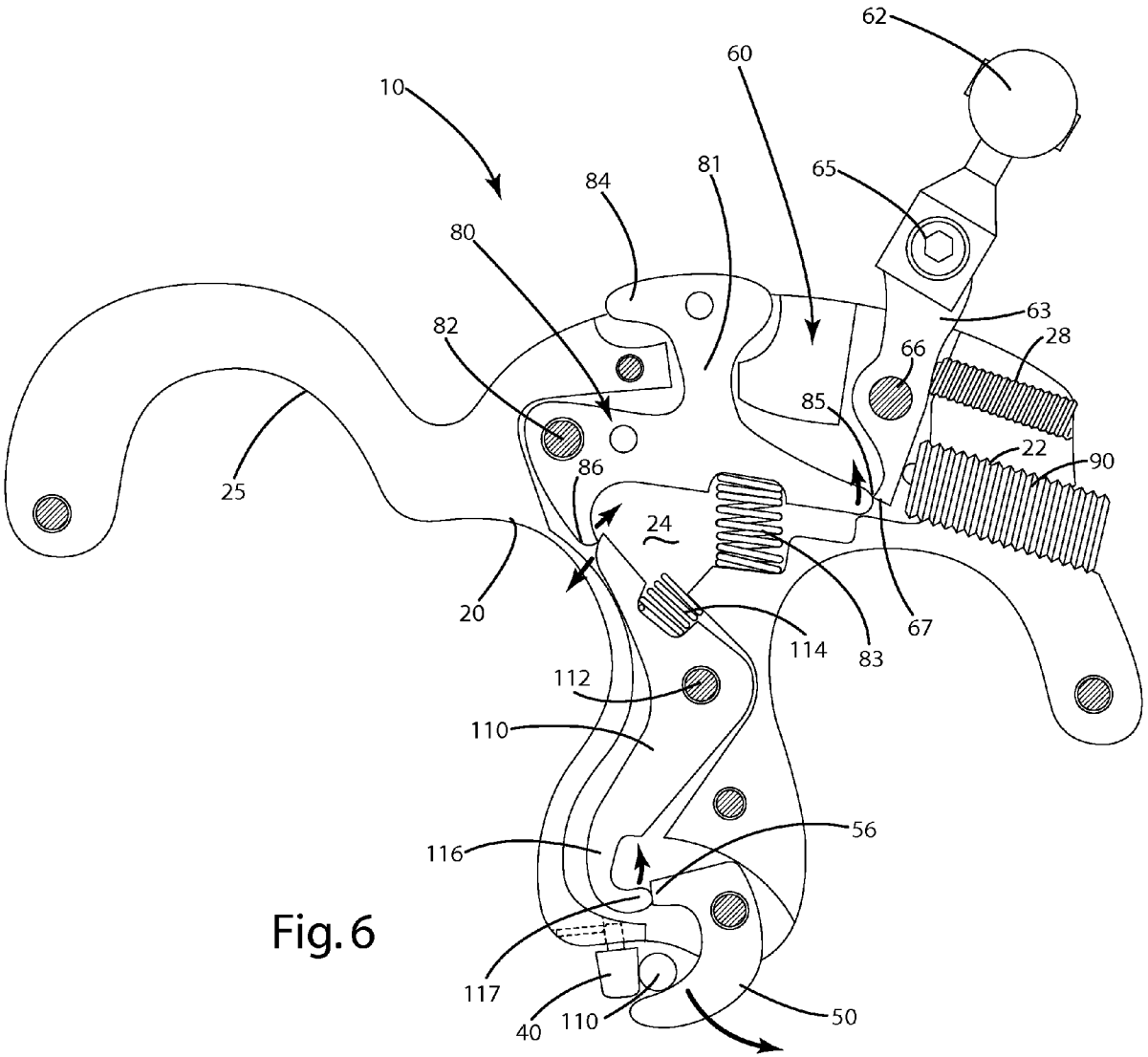
FIG. 6 is a view of the release with the a cover removed to expose internal components in a closed position.
Figure 7:
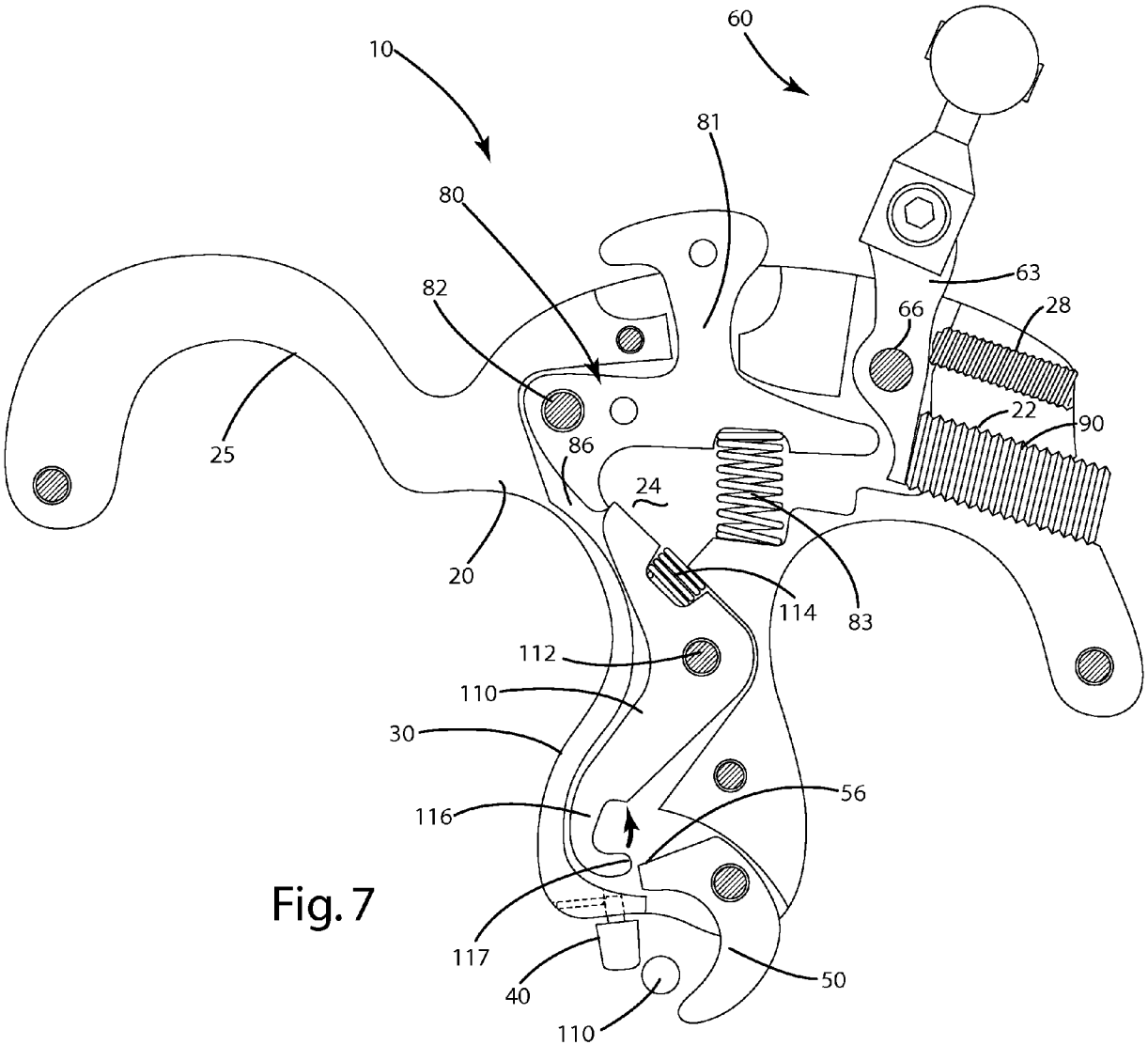
FIG. 7 is another view of the release with the cover removed to expose the internal components in an open position.

In general, the release body can house a substantial portion of the trigger mechanism 60. This trigger mechanism can include a trigger 62 extending from the rear of the release body 20. As shown in FIGS. 6 and 7 (which show the cover 21 of the release removed), the trigger mechanism 60 can include a trigger lever 63 joined with a trigger bar 64 via a fastener 65. The fastener 65 can be selectively adjustable to adjust the orientation of the trigger 62 relative to the trigger bar 64 to accommodate personal preferences of an archer. The trigger lever 63 can be adapted to selectively pivot about the trigger pivot pin 66. Opposite the trigger bar 64, the trigger lever 63 can be engaged by a tension plunger 90. As shown, the trigger 62 can be designed to be actuated by an archer's thumb; however, the design of the trigger can be modified for actuation by any of the archer's digits as desired.

As illustrated in FIGS. 6 and 7, the release body 20 can define a threaded bore 22 in which the tension plunger 90 can be threaded. The tension plunger 90 can further include a tool engagable portion so that an archer can install, remove and adjust the tension plunger 90 relative to the release body 20, and/or the can replace the internal spring 94 in the tension plunger 90 (FIG. 8) with other springs. The release can be offered with a set of internal springs, each of which provides a different resistance to movement of the trigger lever 63, and thus the force/pressure required to depress the trigger and actuate the release.

Figure 8:
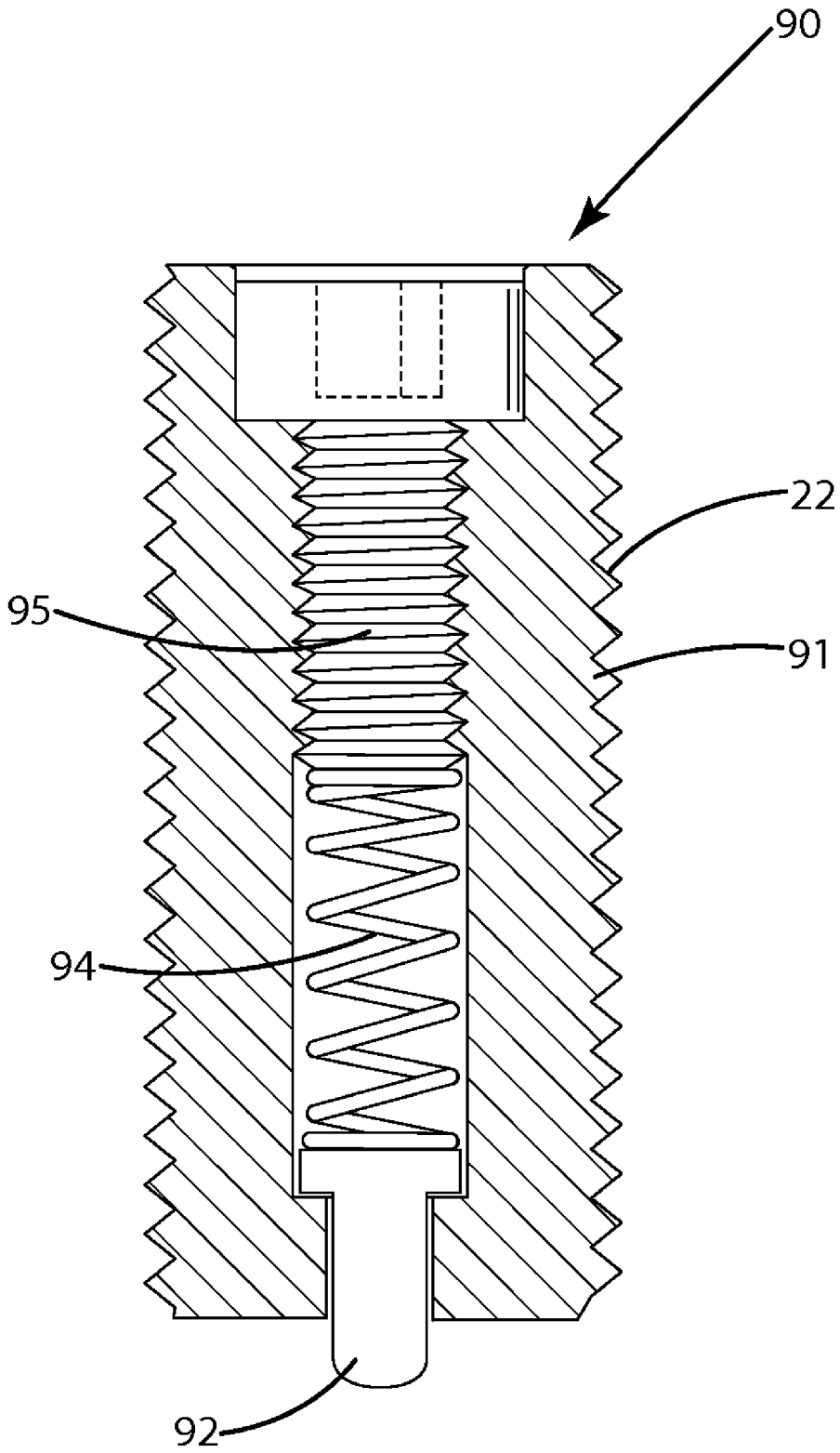
FIG. 8 is a sectional view of an optional plunger of the release.

If a plunger is desired in the release, one plunger 90 suitable for use with the release 10 is shown in FIG. 8. That plunger 90 can include an external threaded portion 91 that engages the threaded bore 22 of the release 10. The plunger can include a plunger portion 92, an internal spring 94 and a cap screw 95. The cap screw can be threaded in the tension plunger 90 to compress the spring 94, thereby pushing the plunger portion 92 to the illustrated extended position, wherein plunger portion 92 protrudes from the tension plunger 90. As shown in FIGS. 6-7, this plunger portion 92 can engage the trigger lever 63, and in effect, dictate the amount of force an archer must exert on the trigger bar 64 to rotate the lever 63 about the pin 66 to subsequently actuate the trigger mechanism and release the bowstring 110.

Where multiple internal springs 64 optionally are provided, each can have different compression characteristics. For example, one spring can be a two pound spring, another a three pound spring, and another an eight pound spring. In one embodiment, the release 10 can be offered for sale with one, two, or more different springs having different compression characteristics to accommodate the personal preferences of an archer. This construction can provide the desired adjustability of the tension plunger to satisfy a variety of trigger pressure preferences.

Although shown in FIGS. 6-8 as being threaded, the tension plunger 90 need not necessarily include threads. For example, the tension plunger 90 can be secured to the release body 20 with a locking collar configuration (not shown). The housing of the tension plunger 40 can include an annular groove (not shown). The release body 20 can include a moveable collar, e-clip or horn clip that engages the groove to secure the spring plunger in place relative to the body 20. Alternatively, the housing of the spring plunger can be a simple non-threaded cylinder housing. A set screw can be engaged against the housing to hold it in place relative to the body. Other suitable alternatives could be substituted as desired. Indeed, the spring plunger can be substituted with a variety of other elements having compressible features. For example, the coil spring 94 shown can be replaced with a leaf-like spring or an elastomeric element. Alternatively, the plunger can include hydraulic or pneumatic components that provide similar compression characteristics.

Referring to FIGS. 6-7, the release 10 can include a trigger set screw 28 that is selectively adjustable within the release body 20. By threading the set screw 28 in the release to a predetermined position, an archer can set the initial position of the trigger lever 63 and thus the trigger bar 64 at a preferred location, thereby making the trigger 62 more or less sensitive.

The trigger 62 can be operably coupled to the hook 50 via a linkage 80 as depicted in FIGS. 6 and 7, which linkage can be generally conventional (as is the one illustrated), and will not be described in substantial detail here. In brief, the linkage 80 can include a set lever 81 that can pivot about a set lever pin 82 fixed to the body 20. The set lever 81 can be biased to an open position (shown in FIG. 7) via the set lever spring 83. The set lever 81 can include a depressible thumb button 84 with which an archer can actuate the release 10 to a set, ready-to-shoot mode. Optionally, the button can be modified and moved so that it is depressible by other digits of the archer as desired. A first end of the set lever 81 can include a set lever engagement edge 85 that engages a trigger sear edge 67 of the trigger lever 63 as shown in FIG. 4. A second end 86 of the set lever 81 can be configured to engage and disengage the pawl 110.

The pawl 110 can pivot about the pawl pivot pin 112 and can be biased to an unset, open position (shown in FIG. 7) by a pawl spring 114. The pawl 110 can include a first end 115 that selectively engages the second end 86 of the set lever 81. The pawl 60 can further include a second end 116 having a pawl edge 117 that selectively engages a hook sear edge 56 of the bowstring hook 50. A variety of other linkages can be used to operably couple the trigger to the hook as desired.

The release 10 and its various components can be constructed from a variety of materials, for example, metal, such as steel, stainless steel and aluminum, as well as other synthetic materials such as polymers, and any combination of the foregoing. Further, the release and its components can be treated with special processes, for example, anodizing, dipping or filming to provide the release and its components with a desired finish and appearance.

III. Method of Manufacture and Operation

In general, the various components of the release 10 can be molded, machined or extruded to obtain their desired configuration. The components can also be treated with special processes as described above to provide a desired finish. With the components constructed, the release 10 can be assembled. To assemble the release, the various components, such as the trigger mechanism 60, the hook 50, adjustable fixed jaw 40, and the optional plunger 90 are joined with the release body 20 and/or release head 30.

With the release assembled, it is ready for use be an archer. With the present invention, however, the archer may adjust or modify the release 10 to satisfy their personal preferences with respect to the gap 51 between the hook 50 and the adjustable fixed jaw 40. To do so, the archer can actuate the release to an adjustment mode or removal mode. In either mode, the user actuates the locking element 70, for example, by loosening the set screw 72 so that it disengages the fixed jaw 40, for example, the post 44. With the locking element disengaged, the fixed jaw 40 is ready to be moved along the axis 102 toward or away from the release head 30 a distance 107, or increments thereof. The archer can subsequently move the fixed jaw to a position that suits their gap preference. In turn, this selectively adjusts the distance 105, which defines the gap 51 between the free end 41 of the jaw and the free end 52 of the hook. The archer can adjust the gap 51 to a preferred setting as desired. When the jaw 40 has been satisfactorily moved, the archer again actuates the locking element to secure the fixed jaw 40 in a fixed position. Alternatively, if the archer desires, they may continue to move the fixed jaw 40 along the axis 102 in a removal mode, and remove the fixed jaw 40 entirely from the release head so that the release is transformed to a hook-only release.

Referring to FIGS. 6 and 7, the general operation of the release will now be described. FIG. 6 shows the release in a closed or ready-to-shoot position; while FIG. 7 shows the release in an open or released position. In the closed position of FIG. 6, a bowstring 110 can be engaged with the bowstring hook 50 and the adjustable fixed jaw 40, with the bowstring occupying a portion or all of the gap between these elements. In this position, the tension plunger 90, and in particular, the plunger 92 exerts a force against the trigger lever 63 urging it to rotate clockwise. However, because the trigger sear edge 67 is engaged against the set lever engagement edge 85, rotation of the trigger lever 63 is restricted and prevented. In this set mode, the pawl 110 is biased in the position shown via the pawl spring 114. Accordingly, the pawl edge 117 engages the hook sear edge 56 of the hook 50, thereby holding the hook in the fixed position shown in FIG. 6. Accordingly, the release can be pulled by the archer and yet will still securely hold the bowstring 110 with the hook 50 so that the bowstring 110 can be drawn.

When the archer is ready to shoot, the archer moves their thumb to engage the trigger bar 64, which eventually moves the elements in the distance shown with small arrows in FIG. 6. In particular, the slight engagement of the trigger bar 64 will counter the force exerted on the opposite end of the trigger lever 63 by the tension plunger 90 sufficiently so that the lever rotates about the pivot pin 66 in the direction shown in FIG. 7. Accordingly, the trigger sear edge 67 moves a sufficient amount so that it disengages the set lever engagement edge 85. Due to the force exerted on the set lever spring 83, the set lever 81 rotates in the direction shown in FIG. 7. Accordingly, the second end 86 of the set lever engages the first end 115 of the pawl 110. The pawl spring 114 rotates the pawl 110 in the direction shown in FIG. 7. Accordingly, the pawl edge 117 disengages the hook sear edge 56. Due to the force on the hook 50 by the bowstring 110, the hook further rotates in the direction shown so that the hook thereby releases the bowstring 110.

To reset the release 10 to a ready-to-shoot mode, the archer again places the hook 50 around the bowstring 110. The archer depresses the thumb button 84 to rotate the lever clockwise (against the force of the set lever spring 83) until the set lever engagement edge 85 sufficiently engages the trigger sear edge 67 so that the release linkage attains the configuration shown in FIG. 6.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

The invention claimed is:

1. An archery release comprising:

a release head;

a trigger;

a hook joined with the trigger, the hook moveable between a closed position in which it retains a bowstring of an archery bow, and an open position, in which it releases the bowstring, a jaw extending from the release head, the jaw cooperating with the hook to form a substantially closed notch in which the bowstring is positionable, the jaw separated from the hook by a distance, the jaw operable in at least one of an adjustment mode in which the jaw is extendable and retractable relative to the release head so that the distance can be selectively varied by a user, and a removal mode, in which the jaw can be completely removed from the release head by a user.

2. The release of claim 1 wherein the jaw is extendable and retractable relative to the release head along a substantially linear axis in the adjustment mode.

3. The release of claim 1 wherein the release head defines a hole and wherein the jaw is at least partially received within the hole in the adjustment mode.

4. The release of claim 1 wherein the jaw includes a free end distal from the release head, wherein the free end moves away from and toward the release head when the jaw is extended and retracted relative to the release head, respectively, in the adjustment mode.

5. The release of claim 1 comprising a locking element joined with the head, the locking element adapted to selectively lock the jaw in a fixed position in the adjustment mode.

6. The release of claim 1 comprising an axis extending from the release head, the jaw extendable and retractable along the axis in the adjustment mode.

7. An archery release comprising:

a release head joined with a release body, the release head defining a hole, the hole having an axis;

a grasping element joined with the release body;

a hook adapted to hold a bowstring of an archery bow, the hook having a hook free end and an attachment end pivotally joined with the release head;

a trigger mechanism joined with the hook to actuate the hook from a closed position in which a bowstring of an archery bow is held by the hook, and an open position in which the bowstring is released, the trigger mechanism including a trigger;

a jaw joined with the release head adjacent the hook, the jaw including a jaw free end and a base, the base received in the hole so that the free end is moveable away from the release head along the axis of the hole; and a locking element joined with the head, the locking element adapted to engage the base to selectively lock the jaw in a fixed position in which the free end is stationary relative to the release head.

8. The release of claim 7 wherein the jaw is completely removable from the release head.

9. The release of claim 7 wherein the base includes a post and a stop, the post being slideably received in the hole, the stop being adapted to engage the release head.

10. The release of claim 9 wherein the locking element is a set screw, and wherein the release head defines a set screw hole, the set screw being threadably received in the set screw hole.

11. The release of claim 7 wherein the jaw moves linearly along the axis of the hole.

12. The release of claim 7 wherein the hook includes a sear, the sear being operably joined with the trigger mechanism, wherein the trigger extends from at least one of the release head and the release body, and is manually operable by the digit of an archer.

13. The release of claim 7 wherein the grasping element is a handle including at least one digit groove.

14. An archery release comprising:

a release head;

a hook moveably joined with the release head;

a jaw joined with the release head adjacent the hook, the jaw including a fixed end and a free end, the fixed end being proximal the release head, the free end being separated from the release head by a distance; and an adjustment element joined with the jaw, the adjustment element operable in at least one of an adjustment mode to change the distance of the free end from the release head, and a removal mode to render the jaw completely removable from the release head.

15. The release of claim 14 wherein the hook is adapted to hold and release a bowstring after the jaw is completely removed from the release head in the removal mode.

16. The release of claim 14 wherein the free end is adapted to move along an axis in the adjustment mode to move the free end toward or away from the release head to change the distance of the free end from the release head in the adjustment mode.

17. The release of claim 14 wherein the adjustment element includes a post extending from the jaw, wherein the release head defines a hole, and wherein the post is disposed at least partially in the hole in the adjustment mode.

18. The release of claim 17 comprising a locking element that engages the post.

19. The release of claim 18 wherein the locking element is a set screw transverse to the hole.

20. A method for modifying an archery release, comprising:

providing a release head including a hook moveably joined with the release head, a jaw extending from the release head along an axis, and a locking element selectively engageable with the jaw to hold the jaw stationary relative to the release head;

actuating the locking element so that the jaw is moveable relative to the release head;

moving the jaw along the axis, outward and away from the release head.

21. The method of claim 20 comprising continuing to move the jaw until it is completely removed from the release head.

* * * * *